US007806310B2

(12) United States Patent
Longobardi

(10) Patent No.: US 7,806,310 B2
(45) Date of Patent: Oct. 5, 2010

(54) METHOD AND APPARATUS FOR REMOTELY ACTIVATING DESTRUCTION OF A GLASS WINDOW

(75) Inventor: Giuseppe Longobardi, Castellammare di Stabia (IT)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/185,051

(22) Filed: Aug. 1, 2008

(65) Prior Publication Data

US 2010/0025449 A1 Feb. 4, 2010

(51) Int. Cl.
*B26F 3/00* (2006.01)

(52) U.S. Cl. ..... 225/1; 225/93

(58) Field of Classification Search ..... 225/1, 225/93

See application file for complete search history.

(56) References Cited

U.S. PATENT DOCUMENTS

| | | | | |
|---|---|---|---|---|
| 3,157,329 | A | 11/1964 | De Gorter | |
| 3,344,995 | A * | 10/1967 | Koetters | 241/1 |
| 3,741,583 | A | 6/1973 | Usui et al. | |
| 5,864,517 | A * | 1/1999 | Hinkey et al. | 367/145 |
| 6,055,829 | A | 5/2000 | Witzmann et al. | |
| 6,470,782 | B1 | 10/2002 | Shimotoyodome et al. | |
| 2004/0251290 | A1 * | 12/2004 | Kondratenko | 225/2 |
| 2005/0091856 | A1 | 5/2005 | McNeill | |
| 2008/0284145 | A1 * | 11/2008 | Breed | 280/736 |

FOREIGN PATENT DOCUMENTS

JP 10001005 1/1998

OTHER PUBLICATIONS

*Fire Safety of Wooden Facades in Residential Suburb Multi-Storey Buildings*, Korhonen et al., ESPOO 2005, VTT Working Papers, ISBN 951.38.6585.1 (URL: http://www.vtt.fi/inf/pdf), 109 pages.
*Fire Emergency Plan*, Singapore Civil Defense Force, 15 pages.

* cited by examiner

*Primary Examiner*—Kenneth E. Peterson
(74) *Attorney, Agent, or Firm*—The Brevetto Law Group

(57) ABSTRACT

The disclosure relates to a method and apparatus for activating destruction of window glass. In one embodiment, the disclosure relates to a method for remotely destroying a glass by providing a glass window having a resonant vibration frequency; identifying a frequency channel on the glass window; positioning a resonator at or near the embedded frequency channel, the resonator providing one of an acoustical vibration or mechanical vibration to the glass window, the acoustical vibration or mechanical vibration substantially matching the resonant frequency of the glass window; detecting an external event necessitating destruction of the window glass; activating the resonator to deliver the acoustical vibration or mechanical vibration substantially matching the resonant frequency of the glass to the frequency channel.

11 Claims, 6 Drawing Sheets

METHOD AND APPARATUS FOR REMOTELY ACTIVATING DESTRUCTION OF A GLASS WINDOW

BACKGROUND

1. Field of the Invention

The instant disclosure relates to method and apparatus for remotely activating destruction of window glass. More specifically, the disclosure relates to a method for identifying an exigent event necessitating remote destruction of a glass window and remotely activating such destruction.

2. Description of Related Art

In the event of an emergency it is often necessary to break or crush a glass window as such windows cannot be opened manually. In other cases, the window frame may be jammed or somehow blocked rendering it impossible or impractical for manual opening. For example, in the case of intense smoke from a fire, it may be necessary to open the window to ask for help, to get fresh air or simply to escape. Similarly, in an event of a car crash where the doors of the vehicle remain locked, the passenger's only means of escape may be through the window. In such cases waiting for help to arrive and break the window from the outside may mean the difference of life and death.

Most buildings and vehicles may have small hammers and other blunt objects within the patrons access which can be used for breaking the glass window in the even of an emergency. In addition, furniture and other physical objects can be used for this purpose. These methods pose several problems.

First, even where there are physical tools available for destroying the glass, the act of breaking requires a physical, human intervention. That is, an individual must physically endeavor to break the window. In the event that there is a pet inside of a smoke-filled room, absent human intervention from the outside, the pet is unable to define an exit strategy by physically breaking the window.

Second, the act of breaking the window requires a tool which may not be available. For example, the tool may be misplaced, stolen or removed for security reasons. In the case of an individual trapped inside a vehicle, smoke from a vehicle fire can enter the passenger compartment rather rapidly endangering the passenger's life absent quick action. If a hammer or other blunt objects is not immediately available, the passenger may not be able to free herself.

Third, the physical act of breaking the window may not be possibly for certain people. For example, small children, the elderly or the handicap may not be physically strong enough to break the glass using a hammer or other blunt objects.

Therefore, there is a need for a method and apparatus for remotely activating destruction of glass window.

SUMMARY

In one embodiment, the disclosure relates to a method for remotely destroying a glass window, the method comprising: providing a glass window having a resonant vibration frequency; identifying a frequency channel on the glass window, the frequency channel embedded within the glass window for expediting destruction of the glass window by including one or more break points in the glass window; positioning a resonator at or near the embedded frequency channel, the resonator providing one of an acoustical vibration or mechanical vibration to the glass window, the acoustical vibration or mechanical vibration substantially matching the resonant frequency of the glass window; detecting an external event necessitating destruction of the window glass; activating the resonator to deliver the acoustical vibration or mechanical vibration substantially matching the resonant frequency of the glass to the frequency channel; and maintaining delivery of the acoustical vibration or mechanical vibration to the frequency channel until such time as the glass window is destroyed; wherein the resonator emits acoustical vibration or mechanical vibration having sufficient intensity for breaking the glass window.

BRIEF DESCRIPTION OF THE DRAWINGS

These and other embodiments of the disclosure will be discussed with reference to the following exemplary and non-limiting illustrations, in which like elements are numbered similarly, and where.

DETAILED DESCRIPTION

Resonance is the tendency of a system to oscillate at maximum amplitude at certain frequencies, known as the system's resonance frequencies (or resonant frequencies). At resonance frequencies, even small periodic driving forces can produce large amplitude vibrations, because the system stores vibrational energy. When damping is small, the resonance frequency is approximately equal to the natural frequency of the system, which is the frequency of free vibrations. Resonant phenomena occur with all type of vibrations or waves; mechanical, acoustic, electromagnetic, and quantum wave functions. Resonant systems can be used to generate vibrations of a specific frequency, or pick out specific frequencies from a complex vibration containing many frequencies.

Figure 1:
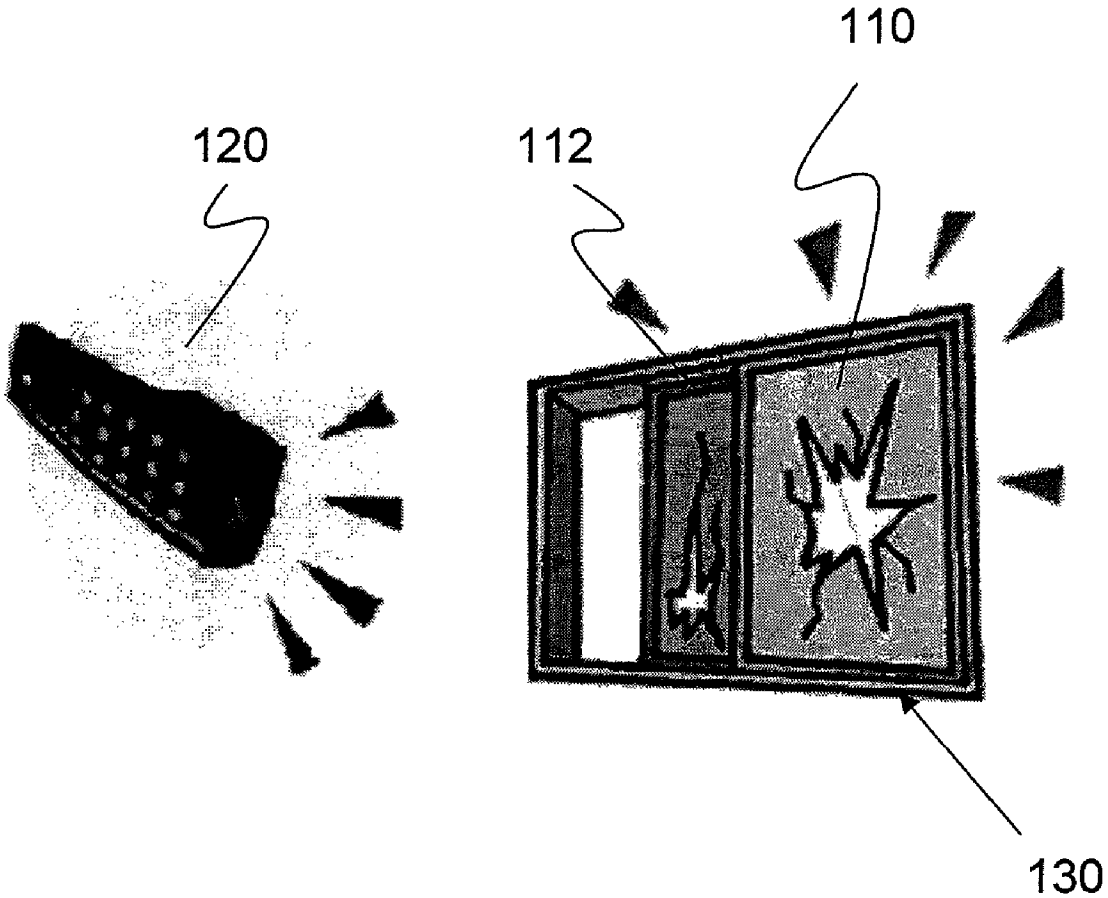
FIG. 1 schematically shows an exemplary representation of one embodiment of the disclosure.

FIG. 1 schematically shows an exemplary representation of one embodiment of the disclosure. In FIG. 1, window glass 110, 112 are held within frame 130. In one embodiment, the disclosure relates to a method and apparatus for breaking or crushing the glass window using remote device 120. Remote device 120 can activate one or more acoustic or mechanical devices positioned within frame 130 proximal to glass 110, 112 for crushing the glass window. Remote device 120 can be activated by an individual upon detecting an emergency. Alternatively, remote device 120 may be replaced by an automated system (not shown) which identifies an exigent circumstance necessitating breaking glass windows 110, 112. For example, a smoke detection system (not shown) can be configured to communicate with the acoustic or mechanical device and activate the device automatically. Upon detecting excessive heat or smoke, the smoke detector can signal the acoustic or mechanical device to break glass windows 110, 120.

Figure 2:
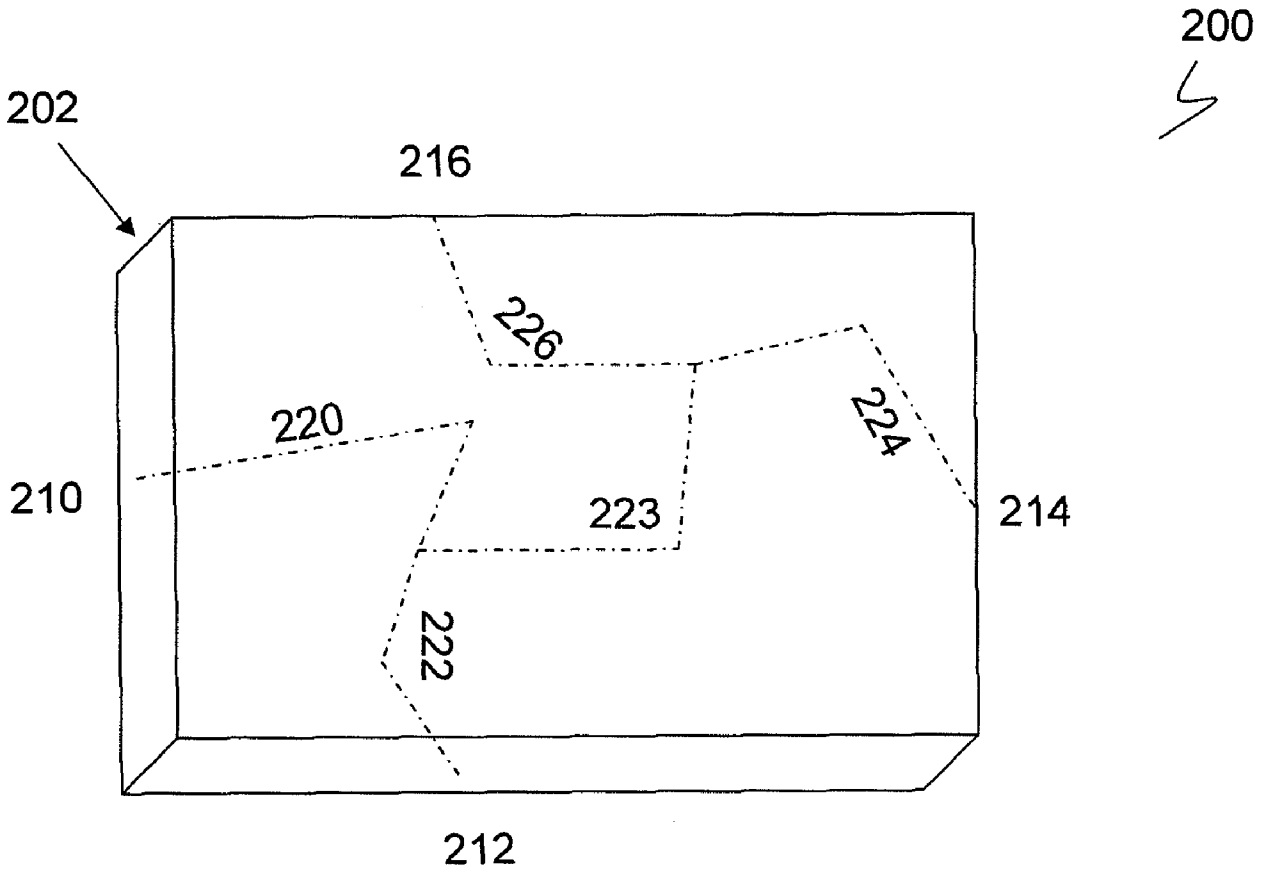
FIG. 2 is a schematic representation of a substrate having a plurality of frequency channels.

FIG. 2 is a schematic representation of a substrate having a plurality of frequency channels. Substrate 200 can be glass or other similar material, including plastics or Plexiglas™. While the disclosure is not limited to brittle substrates, a preferred substrate may define a brittle material such as glass.

Substrate 200 has thickness 202 separating the top and the bottom surfaces. Channels 220, 222, 223, 224 and 226 are formed within substrate 200 and define a plurality of frequency channels. The frequency channels can be designed and embedded in substrate 200 during the manufacturing process. The frequency channels can be configured to be invisible to the naked eye, yet provide a pre-defined path for destruction of substrate 200 from within.

In one embodiment of the disclosure, frequency channels 220, 222, 223, 224 and 226 define a physical path for conveying acoustic or mechanical vibrations broadcasted from resonators (not shown) positioned at locations 210, 212, 214 and 216. The resonator can include any conventional resonator adapted to provide resonant frequency for substrate 200. By forming frequency channels 220, 222, 223, 224 and 226 throughout substrate 200, breaking points and lines can be defined a priori. One or more resonator positioned at termination point of the frequency channel (i.e., locations 210, 212, 214 and 216) enable directing the acoustic energy to the frequency channels thereby providing quicker destruction of substrate 200.

Frequency channels 220, 222, 223, 224 and 226 can be formed in substrate 200, or they may be naturally occurring fracture points or weak points of substrate 200. Identifying such fracture points enables the resonator to focus its energy directly on such fracture points to more readily shatter substrate 200.

Figure 3:
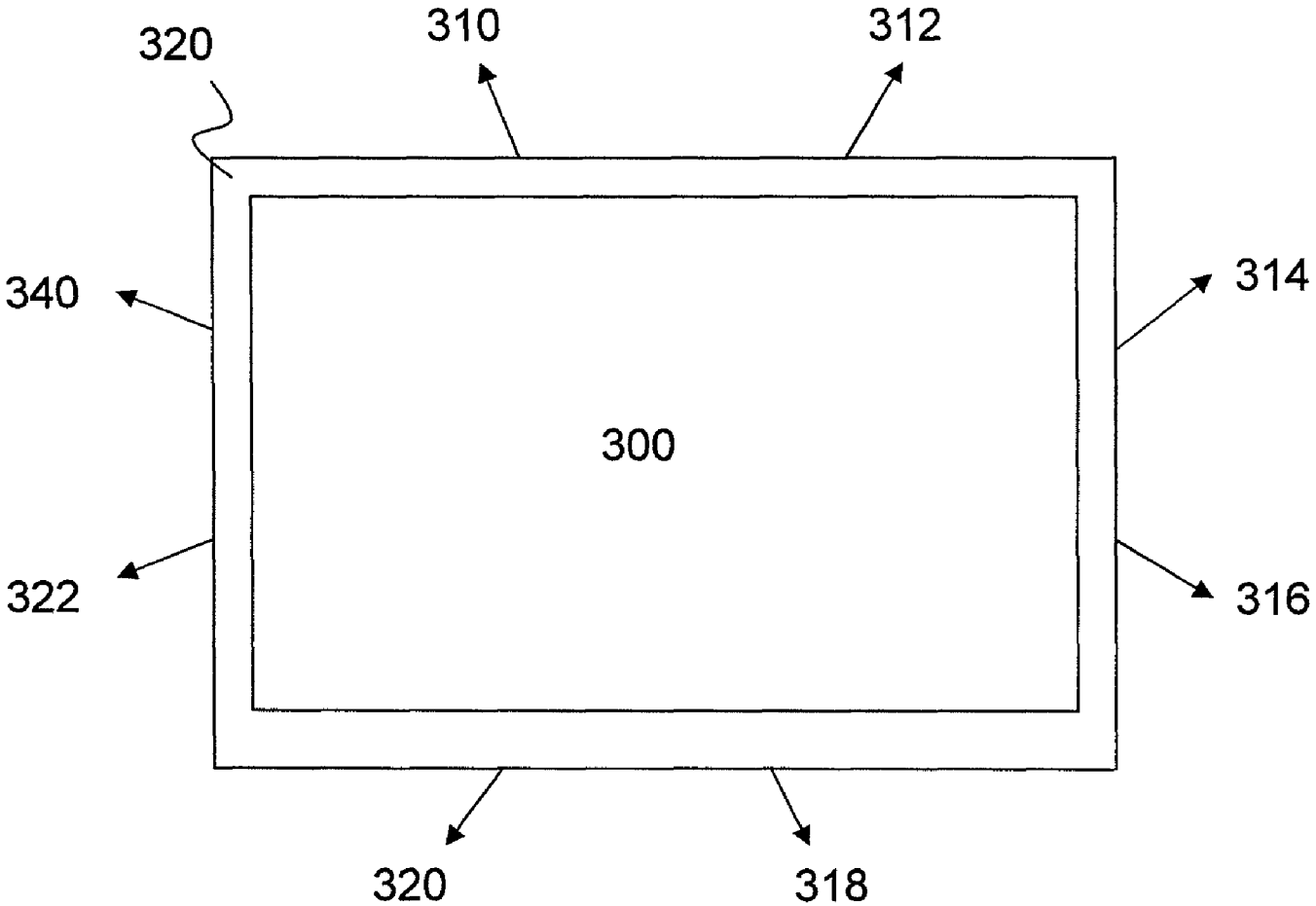
FIG. 3 is a schematic representation of an exemplary embodiment of the disclosure.

According to one embodiment of the disclosure, the glass window shatters by placing the glass under physical stress. FIG. 3 is a schematic representation of an exemplary embodiment of the disclosure. Glass substrate 300 of FIG. 3 is shown with frame 320. As shown by arrows 310, 312, 314, 316, 318, 320, 322 and 324, mobile and divergent glides can be use to pull the glass window in different directions. For example, a rack-and-pinion system can be used to place stress or strain on the glass window, causing it to shatter. Having identified frequency channels and other weak points on the glass can help expedite the shattering.

Figure 4:
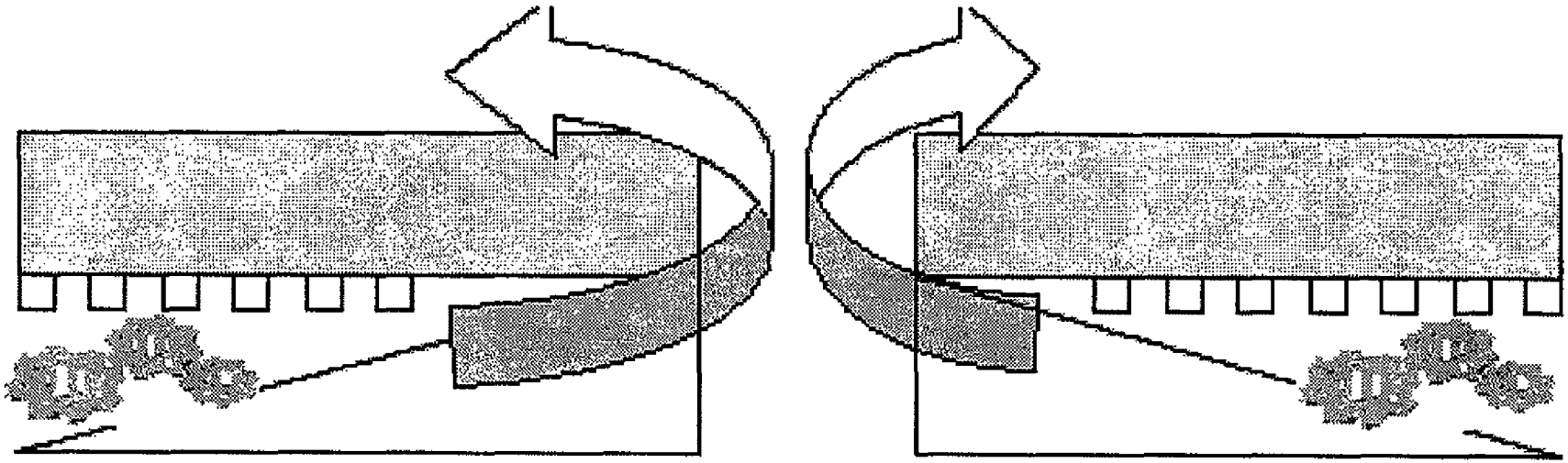
FIG. 4 shows an exemplary a rack and pinion system for use in conjunction with the embodiment shown in FIG. 3.

Referring now to FIGS. 3 and 4 simultaneously, FIG. 4 shows an exemplary a rack and pinion system for use in conjunction with the embodiment shown in FIG. 3. The rack and pinion system of FIG. 4 can be situated within frame 320. FIG. 4 depicts an exemplary rack and pinion system with two pulling mechanisms each having a toothed bar meshing with a set of gearwheels or pinions. One mechanism can be placed on each side of frame 320. The invention is not limited to rack and pinion systems having two mechanisms, and any suitable means of placing a stress on glass substrate 300 may be utilized without departing from the nature of the invention.

Figure 5:
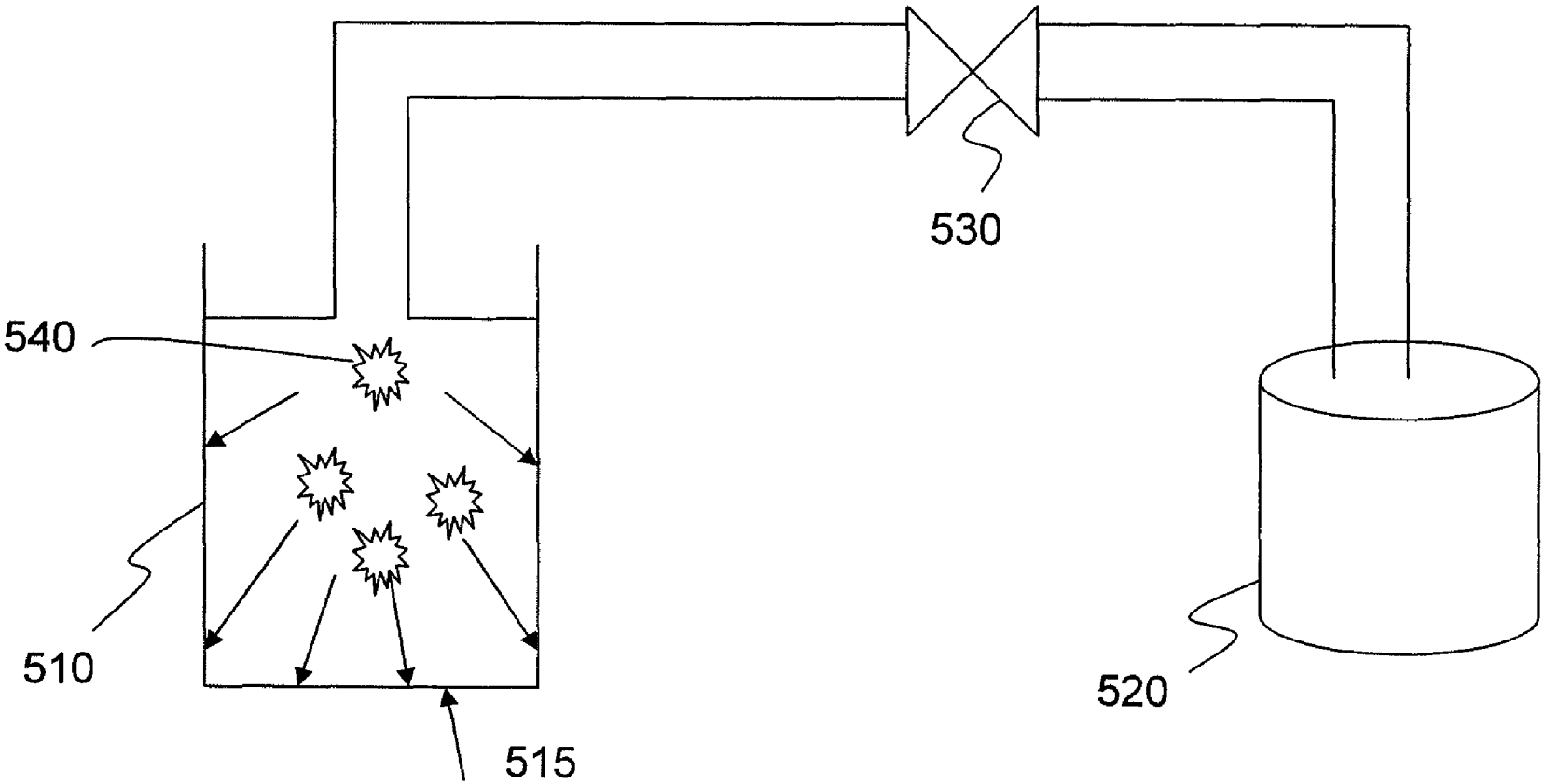
FIG. 5 schematically illustrates an activation mechanism for crushing a glass window according to another embodiment of the disclosure.

FIG. 5 schematically illustrates an activation mechanism for crushing a glass window according to another embodiment of the disclosure. In the embodiment of FIG. 5 includes glass substrate 510 has thickness 515. Glass substrate 510 can comprises a double-sided window pane or it can comprise one ore more hollow areas within. The glass substrate can be coupled to reservoir 520 through valve 530. When the requisite external threshold (i.e., heat, smoke, etc.) has been reached or exceeded, an actuator (not shown) will trigger ignition of a gas generator propellant 540 to rapidly inflate inside glass thereby increasing the pressure inside and causing breakage of the glass window.

Gas generators 540 can comprise conventional gas generators, including a propellant mixtures which chemically react or burn to produce large volumes of gas. It should be noted that any chemical reaction that produces substantial pressure can be used to implement the embodiment of FIG. 5. For example, glass substrate 510 can be manufactured with a reactant gas therein. The glass substrate can communicate with reservoir 520 through one or more intermediary means. Reservoir 520 can contain a second reactant which, when in contact with the first reactant, would create a substantial internal pressure. Once an external event has been detected, reservoir 520 can direct its reactant gases to the glass substrate 510, thereby causing a chemical reaction which would result in shattering the glass substrate. To avoid charred glass pieces from flying about and endangering people, a thin, protective layer of clear film can be applied to one or both surfaces of the glass window.

Figure 6:
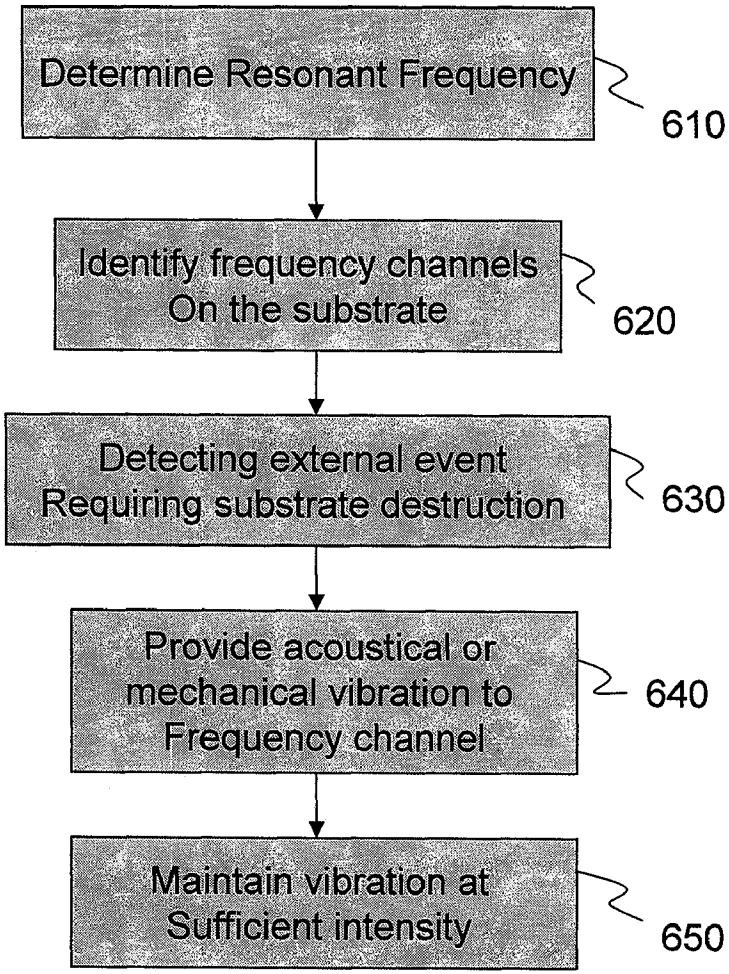
FIG. 6 shows a flow-diagram from implementing an embodiment of the disclosure.

FIG. 6 shows a flow-diagram from implementing an embodiment of the disclosure. The exemplary process of FIG. 6 starts at step 610 where the resonant frequency of the glass window or other substrate is determined. To the extent that the resonant frequency is a characteristic of the substrate, such values may be available in the literature. At step 620, one or more frequency channels are identified on the substrate. The frequency channels may include breaking points naturally occurring at the weak points of the substrate. Alternatively, the frequency channels may comprises one or more channels, vias or other fracture points formed on the glass window during the manufacturing process. At step 630 an external event is detected requiring destruction of glass window. As discussed, the external event can be detected by any conventional means for detecting such events, including sensors, etc., and this automatically enables and activates the system. Alternatively, the system can be manually enabled and activated, for example, through a button or a remote control.

At step 640, acoustical or mechanical vibrations are provided to one or more of the frequency channels. Alternatively, step 640 may comprise providing reactant gas or other means discussed above to the glass window in order to bring about the glass window's destruction. In the event that mechanical or acoustical vibration is used, the intensity and the duration of such vibration must be sufficient to result in quick destruction of the glass window (see Step 650). While any acoustical or mechanical vibration can be used, a more expedient result will be observed by matching the frequency of the mechanical or the acoustical vibration to the substrate's resonant frequency.

A conventional resonator can be used to provide the acoustical or mechanical vibration. To this end, one or more resonator can be placed at or near the glass window and its vibrational energy can be directed to the weak points and breaking points of the glass window. The resonator can operate under the building or the vehicle's power. Alternatively, the resonator can be equipped with an internal power source for autonomous response.

While the principles of the disclosure have been illustrated in relation to the exemplary embodiments shown herein, the principles of the disclosure are not limited thereto and include any modification, variation or permutation thereof.

What is claimed is:

1. A method for breaking a glass window, wherein said glass window comprises a glass substrate supported by a window frame, the method comprising:

forming a frequency channel embedded within the glass substrate at a predefined location, said frequency channel defining a physical path for conveying acoustic or mechanical vibrations produced by a resonator configured to vibrate at said resonant frequency;

positioning the resonator within the frame at an edge of the glass substrate, the resonator being positioned at a termination point of the frequency channel;

detecting an exigent circumstance; and activating the resonator in response to the detecting of said exigent circumstance.

2. The method of claim 1, wherein the resonator is a first resonator, the termination point is a first termination point, and the embedded frequency channel is a first frequency channel, the method further comprising:

positioning a second resonator at a second termination point of a second frequency channel.

3. The method of claim 1, further comprising:

providing a sensor coupled to the resonator configured to detect the exigent circumstance.

4. The method of claim 3, wherein the embedded frequency channel is configured to not be visible.

5. The method of claim 1, wherein the embedded frequency channel is embedded in the glass substrate during a manufacturing process.

6. The method of claim 1, wherein the detecting of said exigent circumstance comprises either detecting smoke or detecting heat.

7. A system configured to break a glass window comprising a glass substrate having a resonant frequency, the system comprising:

the glass substrate comprising a frequency channel embedded at a predefined location within the glass substrate, wherein said frequency channel defines a physical path for conveying acoustic or mechanical vibrations produced at said resonant frequency;

a frame configured to support the glass substrate;

a sensor configured to detect an exigent circumstance; and a resonator positioned within the frame at an edge of the glass substrate and being configured to break said glass substrate by vibrating at the resonant frequency in response to said exigent circumstance being detected by the sensor, said resonator being positioned at a termination point of the frequency channel.

8. The system of claim 7, wherein the resonator is a first resonator, the termination point is a first termination point, and the embedded frequency channel is a first frequency channel, the system further comprising:

a second resonator positioned at a second termination point of a second frequency channel.

9. The system of claim 7, wherein the embedded frequency channel is configured to not be visible.

10. The system of claim 9, wherein the embedded frequency channel is embedded in the glass substrate during a manufacturing process.

11. The system of claim 7, wherein the detecting of said exigent circumstance comprises either detecting smoke or detecting heat.

* * * * *